US006098017A

United States Patent [19]

Brown et al.

[11] Patent Number: 6,098,017

[45] Date of Patent: Aug. 1, 2000

[54] ADJUSTABLE HEAD ASSEMBLY FOR ULTRASONIC LOGGING TOOLS THAT UTILIZE A ROTATING SENSOR SUBASSEMBLY

[75] Inventors: Mack H. Brown, Houston; Frank H. McCurdy, Alvarado; James W. Stroud, Houston, all of Tex.

[73] Assignee: Halliburton Energy Services, Inc., Houston, Tex.

[21] Appl. No.: 08/925,970

[22] Filed: Sep. 9, 1997

[51] Int. Cl.[7] ..... G01V 1/52

[52] U.S. Cl. ..... 702/1; 702/6

[58] Field of Search ..... 702/6, 1; 367/35

[56] References Cited

U.S. PATENT DOCUMENTS

| | | | |
|---|---|---|---|
| 4,255,798 | 3/1981 | Havira | 367/35 |
| 4,495,606 | 1/1985 | Smith | 367/86 |
| 4,802,145 | 1/1989 | Mount, II | 367/35 |
| 4,805,156 | 2/1989 | Attali | 367/35 |
| 4,876,672 | 10/1989 | Petermann et al. | 367/35 |
| 5,043,948 | 8/1991 | Hallmark et al. | 367/35 |
| 5,089,989 | 2/1992 | Schmidt et al. | 367/35 |
| 5,161,764 | 11/1992 | Roney | 248/231.7 |
| 5,178,014 | 1/1993 | John, Jr. et al. | 73/622 |
| 5,251,479 | 10/1993 | Siegfried | 73/155 |
| 5,763,773 | 6/1998 | Birchak et al. | 73/152.58 |
| 5,841,734 | 11/1998 | Ritter et al. | 367/35 |

FOREIGN PATENT DOCUMENTS

| | | |
|---|---|---|
| 2011437 | 9/1990 | Canada . |
| WO9749894 | 12/1997 | WIPO . |

OTHER PUBLICATIONS

Halliburton Energy Services; CAST–V™ Higher Resolution, Precise Digital Information, and Simultaneous Measurements Provide Complete Acoustic Visualization; 1995; (2 p.).

*Primary Examiner*—Christine K. Oda
*Assistant Examiner*—Victor J. Taylor
*Attorney, Agent, or Firm*—Conley, Rose & Tayon, P.C.

[57] ABSTRACT

In preferred embodiments described herein, a transducer head is affixed to the lower end of a wireline borne scanner sub for rotation thereby. The transducer head includes a pair of transducers which may be adjusted radially inward or outward with respect to the head so that optimum standoff may be achieved without the need for numerous transducer heads of various sizes. In a described exemplary embodiment, the transducers are adjusted by means of an indexing system which permits fine control over the amount of adjustment for the transducers.

22 Claims, 7 Drawing Sheets

34
SURFACE ELECTRONICS
26
36
28
16
12
10
30
18
32
14
24
22
39
37
50
72
74
20

ADJUSTABLE HEAD ASSEMBLY FOR ULTRASONIC LOGGING TOOLS THAT UTILIZE A ROTATING SENSOR SUBASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to apparatus and methods for acoustically determining wellbore conditions in cased and uncased bore holes. In more particular aspects, the invention relates to acoustic scanning tools for conducting ultrasonic inspections and evaluations.

2. Description of the Related Art

In conjunction with drilling operations, wireline logging tools are used to inspect the cased and uncased portions of a borehole. These logging tools typically incorporate ultrasonic transducers which, through known pulsed echo techniques, are able to derive information concerning the condition of the wellbore. In a cased wellbore, the logging tools are used to determine the thickness of casing, the presence of damaged casing, the internal diameter of the casing and the condition of the cement bond along the casing's outer diameter. In uncased portions of a wellbore, the wireline logging tools are used to determine features in the bore hole wall such as dips, holes and cracks.

There are basically two types of logging tools in use today. A scanning type tool rotates a transducer so that the transducer scans the borehole circumferentially. There are also fixed, or non-rotatable tools which use numerous fixed transducers, each of which is trained upon an angular segment of the borehole's circumference. An example of a fixed type of tool is the Pulse Echo Tool (PET) available from Halliburton Company. PET is primarily designed as a tool for use in cased boreholes. It contains eight ultrasonic transducers which are disposed along the length of a long cylindrical housing. The transducers are also spaced from each other angularly so that each of the transducers surveys a different portion of the wellbore casing. Currently, the transducers are angularly spaced at 45° increments about the circumference of the housing. The longitudinal spacing of the transducers is necessary since the diameter of the housing for the PET tool is not large enough to accommodate placement of more than one transducer.

The transducers of the PET measure the bond of the cement to the casing. They can also determine the actual thickness of the casing, detect channels and measure inner casing corrosion. The transducers of the PET can be adjusted radially inwardly or outwardly with respect to the tool's housing in order to achieve an optimum standoff. However, this operation must be accomplished by using a special tool to unscrew and remove a threaded transducer retainer. Then a locating spring, or split ring, must be placed into a desired slot on the transducer, the transducer replaced, and the transducer retainer replaced and retightened. In a typical logging operation using the PET tool, the PET tool is moved slowly upward (or possibly downward) through the wellbore. The system electronics "fire" the transducers (or obtain information readings) in a periodic manner so that relatively continuous readings are available for each discrete portion of the casing being logged. Fixed tools, such as the PET, are useful in areas of a borehole which are cased, but they are generally not suitable for use in uncased portions of a borehole. This is because the eight individual transducers provide eight individual sets of readings. There is a discontinuity between each of these sets. In an uncased wellbore portion, the coverage provided by transducer readings must be relatively continuous and cover virtually all areas of the inside of the borehole in order to be useful.

An example of a scanning type tool is the Halliburton CAST-V™. The CAST-V™ incorporates a wireline borne scanner sub which contains a motor. The motor rotates a transducer head at the lower end of the scanner sub. The transducer head contains a single transducer which is used to take periodic readings concerning the condition of the cased borehole as the head is rotated. A fixed weighted plug is located directly opposite the transducer on the transducer head and serves to counterbalance the weight of the transducer. Both the transducer and the plug are disposed within the head in a fixed manner and cannot be adjusted radially outwardly or inwardly with respect to the transducer head. As a result, the CAST-V™ system is sold with a number of different diameter heads, and the operator selects the head which best places the transducer at an optimum standoff from the casing wall. For example, a CAST-V™ system might be supplied with a 3–⅝ inch diameter head, 4–⅜ inch diameter head, 5–⅝ diameter head and 7 inch diameter head.

A proper standoff distance is important since logging systems which incorporate transducers are vulnerable to mud attenuation effects. Too small a spacing between the face of the transducer and the borehole wall causes secondary transmissions to interfere with the reflections of interest. On the other hand, if the spacing between the face of the transducer and the borehole wall is too great, the transducer's signals will attenuate greatly, particularly where oil-based borehole fluids are being used. Therefore, it is important that the transducer face be located an optimum distance from a borehole wall. For this reason, a number of different sized heads are provided with the CAST-V™ system. The borehole size may sometimes change as investigation is conducted, even within a single well. When this occurs, the wireline tool must be removed from the well, the head then replaced, the scanner evacuated and refilled with pressure compensation fluid, and the wireline tool rerun into the wellbore.

In a tool having a rotatable head, a balanced head weight is also important. If one portion of the head is heavier than another, the entire scanning tool tends to move and deviate from its longitudinal axis as the head is rotated. The tool, therefore, oscillates slightly during the scanning operation. Oscillation of the scanning tool in this manner causes the time for signal transit (i.e., the time for signals emitted from the transducers to bounce back to the transducers) to vary, potentially affecting the validity of the readings obtained.

The present invention addresses the problems of prior art.

SUMMARY OF THE INVENTION

In preferred embodiments described herein, a transducer head is affixed to the lower end of a wireline borne scanner sub for rotation thereby. The transducer head includes a pair of transducers which may be adjusted radially inward or outward with respect to the head so that optimum standoff may be achieved without the need for numerous transducer heads of various sizes. Preferably, the transducers are adjusted by means of an indexing system which permits fine control over the amount of adjustment for the transducers. The pressure compensation fluid is not disturbed during this adjustment.

DETAILED DESCRIPTION OF THE PREFERRED EMBODIMENTS

Figure 1:
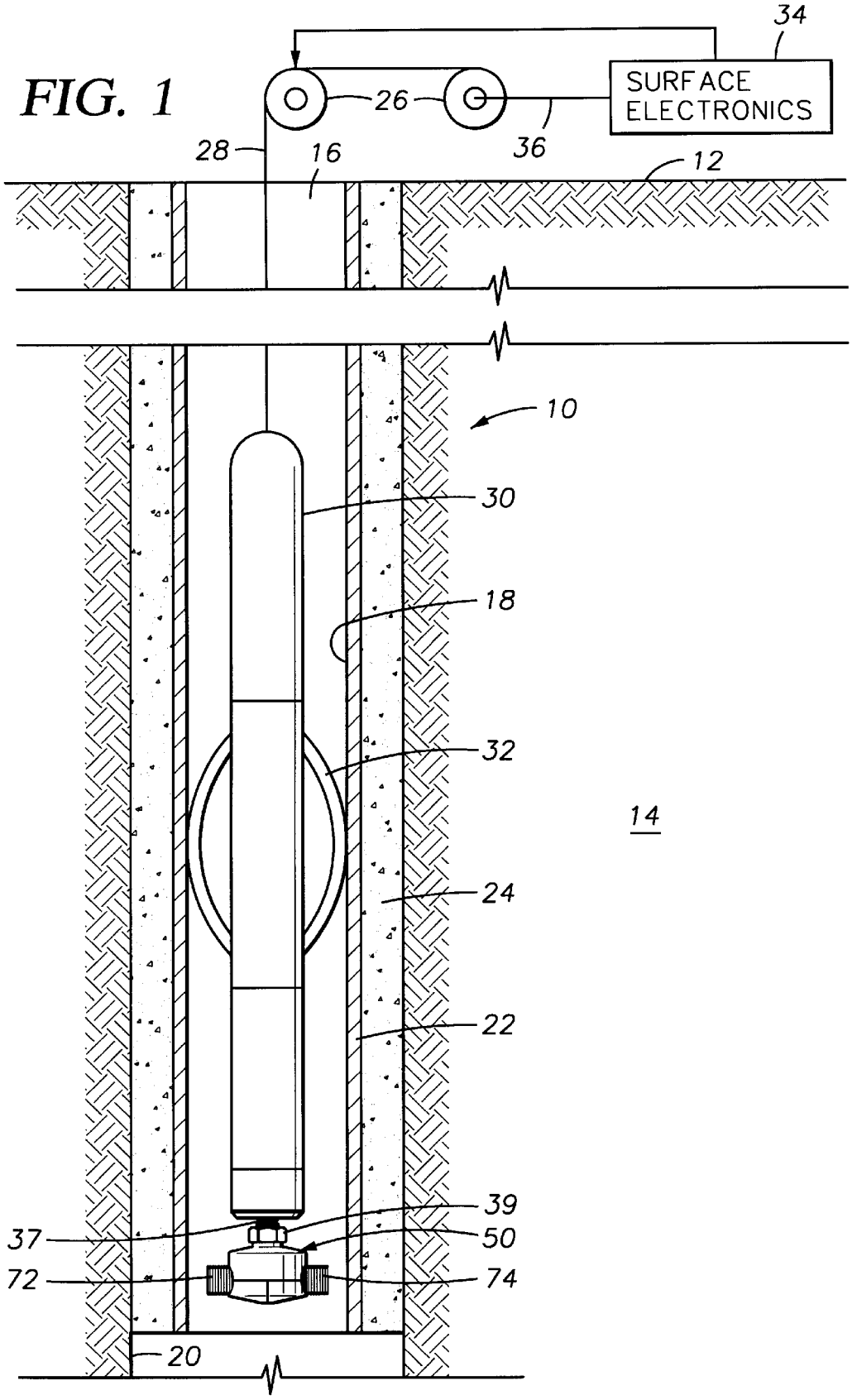
FIG. 1 is a overall schematic drawing of a scanning assembly which is disposed by wireline into a wellbore.

Referring first to FIG. 1, there is shown a wellbore 10 which extends downward from the surface 12 through an earth formation 14. The wellbore 10 encloses a borehole 16 having an upper cased portion 18 and a lower uncased portion 20. The cased portion 18 contains metal casing 22 which lines the borehole 16, being bonded to inside of the borehole 16 by cement 24. At the surface 12 of the well 10, a wireline suspension assembly 26 is shown from which a wire line 28 is disposed into the wellbore 10.

A logging string is formed where the lower end of the wireline 28 is affixed to a scanning tool 30. The scanning tool 30 is of the type exemplified by the CAST-V™ scanner available from Halliburton Company. The scanning tool 30 includes a motor assembly (not shown) which rotates a shaft generally about the longitudinal axis of the tool 30. A centralizer or stabilizer 32 is used to center the tool 30 within the borehole 16. The scanning tool 30 contains internally a resolver element (not shown) which coordinates the orientation and operation of transducers used to take readings. This information is provided as background information only as a detailed discussion of the internal operations of scanning tools is not necessary to an understanding of the present invention. As such operations are generally understood in the art in any case, they will not be described here. Electrical communications are provided between the tool 30 and surface electronics 34 via a line 36.

Figure 5:
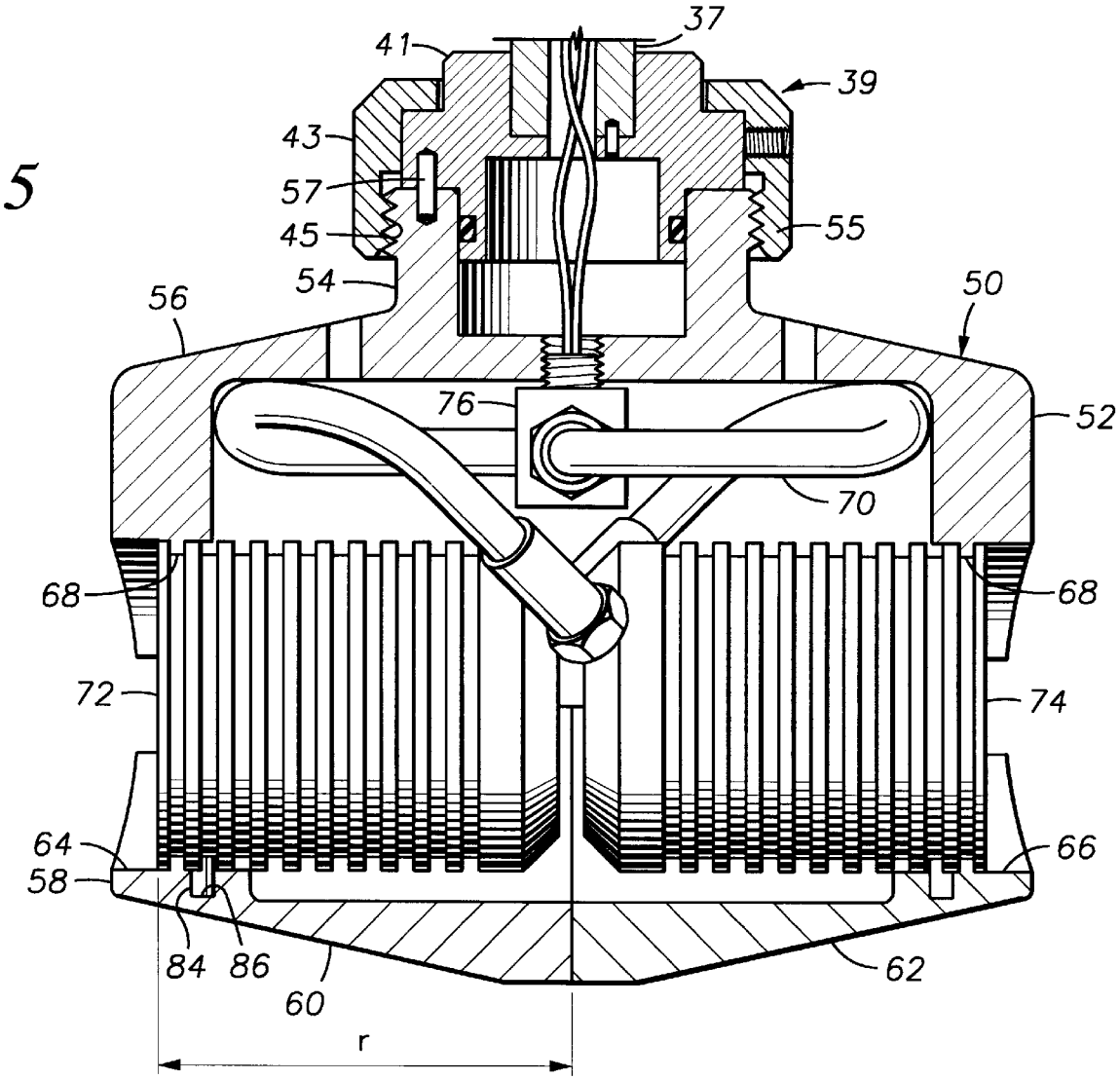
FIG. 5 is a side cross-sectional view of the scanning head of FIG. 2 with the transducers in a radially retracted configuration.
Figure 6:
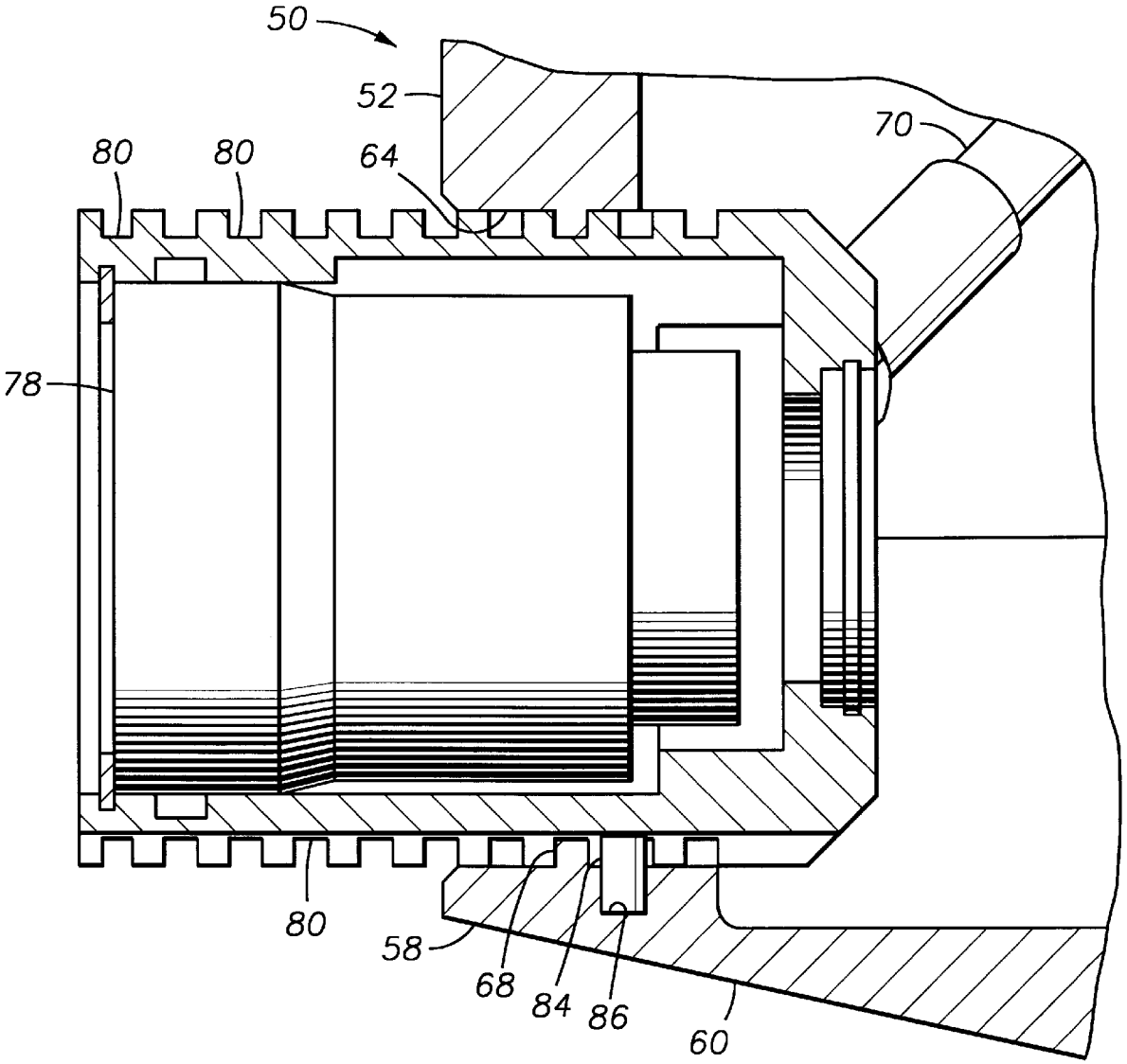
FIG. 6 is a close-up detail of a transducer disposed within a transducer aperture.

A transducer head 50 is affixed to the lower end of the scanner tool 30 so that the head 50 can be rotated with respect to the scanner tool 30 by the motor within the tool 30. As can be seen in FIGS. 1 and 5, a rotatable shaft 37 extends from the lower end of the tool 30 and terminates in a collar 39. As FIG. 5 shows, the collar 39 includes a base 41 and a surrounding outer portion which is threaded at 45.

Referring now to FIGS. 2–6, the transducer head 50 is shown in greater detail. The head 50 includes a generally cylindrical housing 52. An upwardly extending neck 54 has a threaded portion 55 which is formed in a complimentary manner so as to be secured to the outer threaded portion 43. The neck 54 is affixed to the collar 39 by disposing the base 41 within the neck 54 and then tightening the outer threaded portion along the threads 55 of the neck 54. Locating pins 57 are disposed within complimentary pin holes 59 in the collar 39 and in the neck 54. Although there is only one locating pin 57 shown, there are preferably three or more of them in a typical assembly. The presence of the locating pins 57 assures alignment of the head 50 with respect to the tool 30 so that the base 41 will properly engage the neck 54.

The housing 52 is made up of an upper half 56 and a lower half 58. The lower half, is comprised of two separable shells 60, 62. This arrangement is best understood with reference to FIG. 2 which shows the housing 52 partially disassembled with one of the separable shells 60 of the lower half 58 removed. Transducer apertures 64, 66 are present on either side of the housing 52. An indexing flange 68 is disposed about the circumference of each of the transducer apertures 64, 66.

Control wiring 70 is disposed within the housing 52 of the head 50 and is affixed to two transducers 72, 74. The control wiring 70 is also affixed to a central plug 76 which can interconnect to a complimentary member in the scanning tool 30 so that an electrical connection can be established from the transducers 72, 74 through the wireline 28 to the surface of the well and pressure compensation fluid may be communicated between the scanning tool 30 and the interior of the housing 52. Each of the transducers 72, 74 is generally cylindrically shaped and presents a working surface 78 (see FIGS. 2, 4 and 6) which is the portion of the transducer which must be directed toward the surface of the borehole 16 in order to obtain information. The transducers 72 and 74 are constructed so as to be very closely of the same size and weight. The distance from the working surface 78 to the center of the head 50 is known as the transducer scanning radius, "r".

Figure 2:
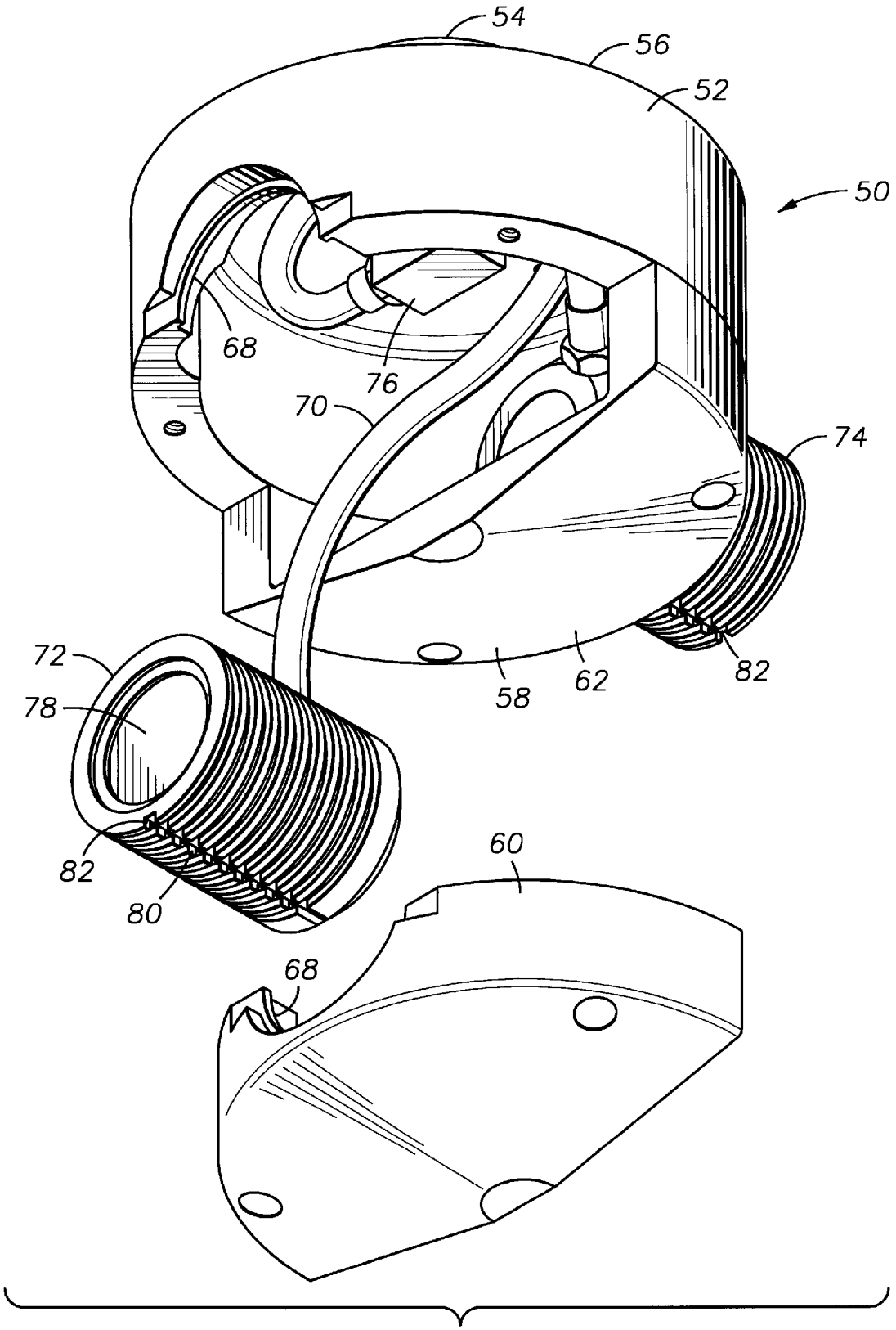
FIG. 2 is a partially exploded view of a scanning head constructed in accordance with the present invention.
Figure 3:
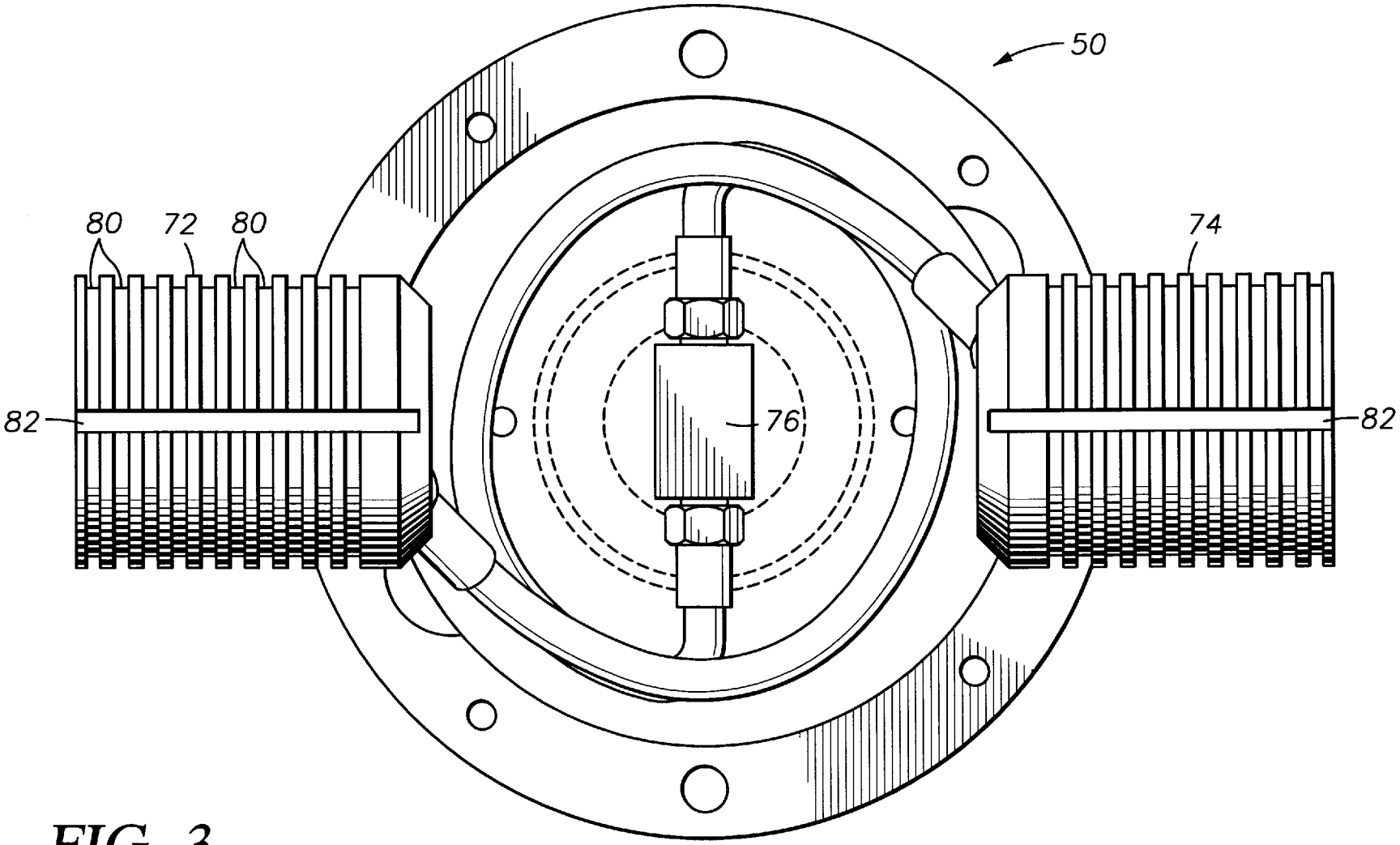
FIG. 3 is a top cross-sectional view of the scanning head of FIG. 2.
Figure 4:
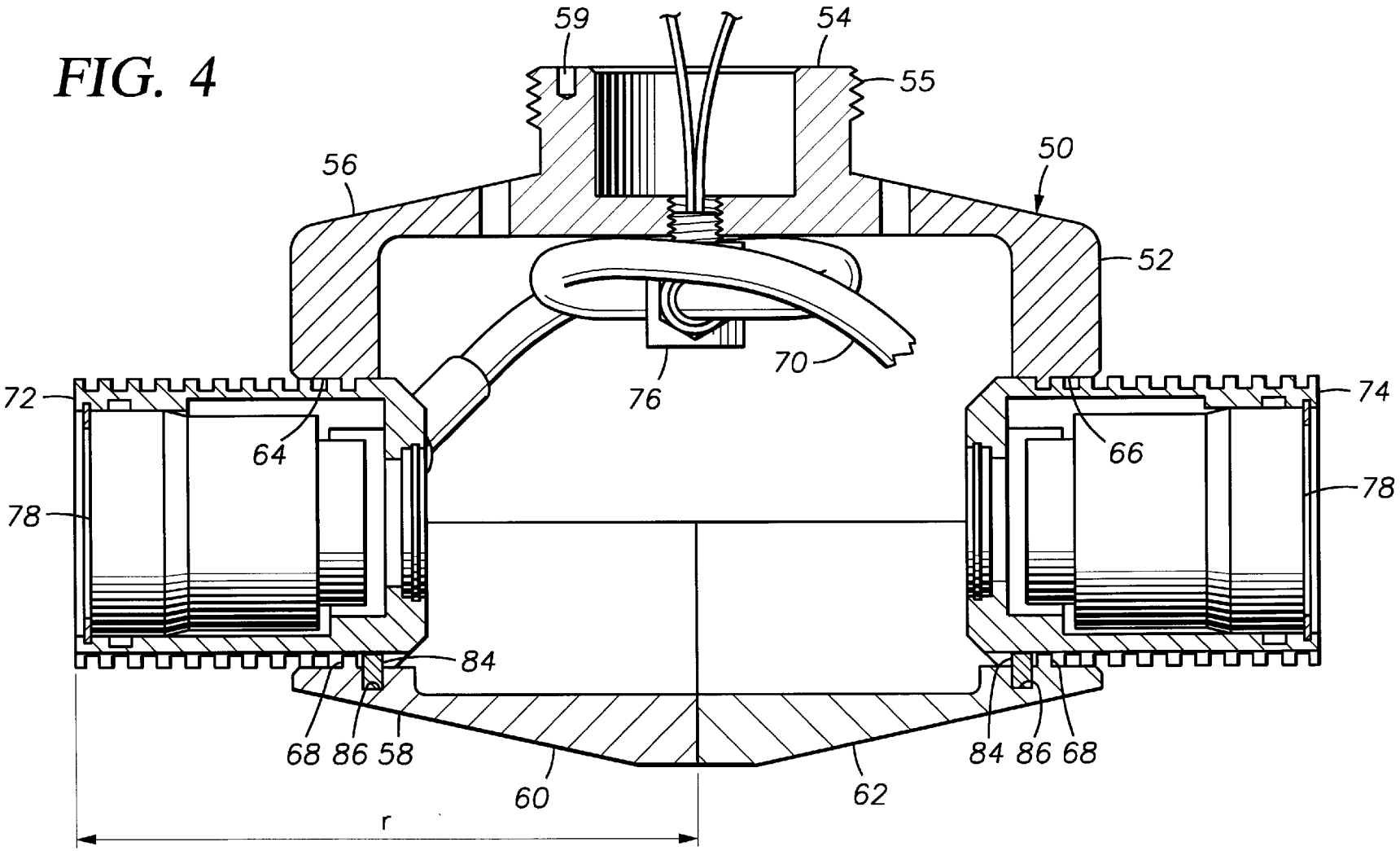
FIG. 4 is a side cross-sectional view of the scanning head of FIG. 2 with the transducers in a radially extended configuration.
Figure 7:
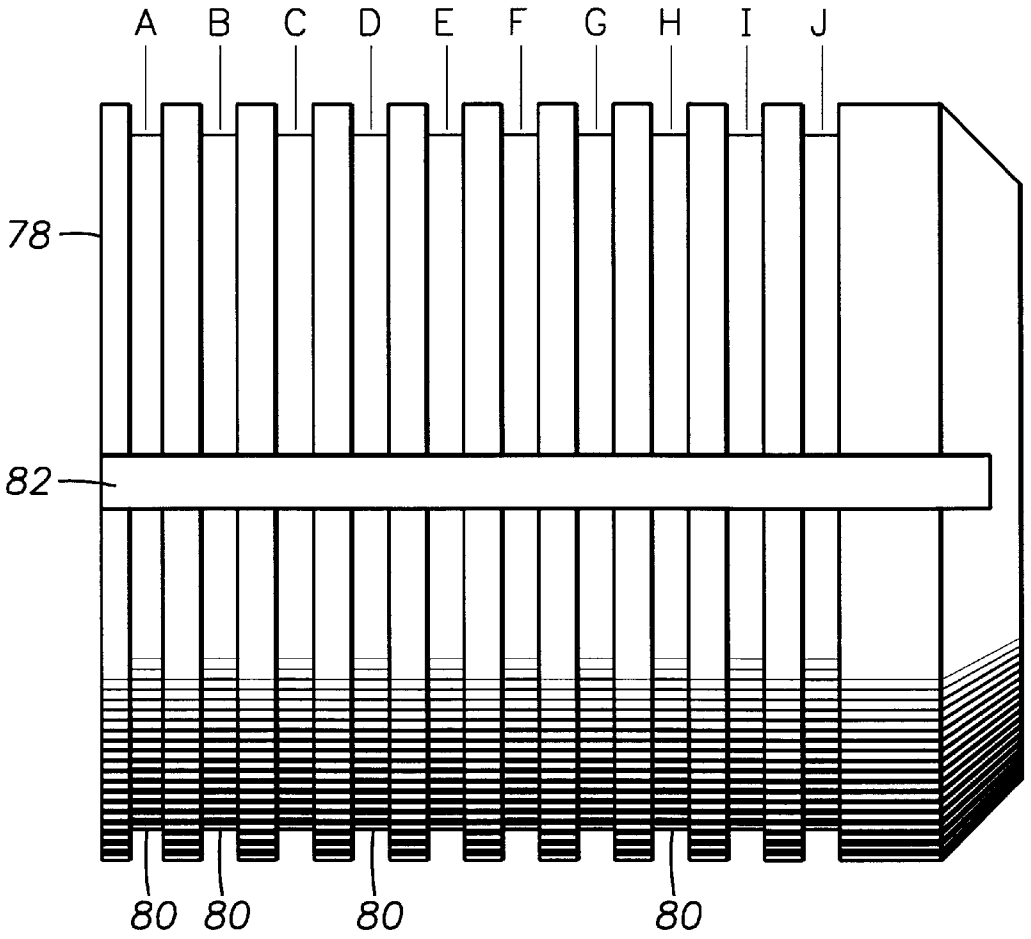
FIG. 7 is an external view of a transducer.

A number of annular grooves 80 is inscribed about the outer surface of each transducer 72, 74. Additionally, a longitudinal channel 82, visible in FIGS. 2, 3 and 7, is disposed in a portion of each transducers' outer surface. A locating pin 84 (shown in FIGS. 4, 5 and 6) is disposed partly within a pinhole 86 in the aperture and partly within the longitudinal channel 82 in one of the transducers 72, 74. The locating pin 84 prevents the transducers 72, 74 from being rotated within the transducer apertures 64, 66.

In operation, transducer scanning radius, "r", may be readily adjusted by removing the lower half 58 of the transducer housing 52 from the upper half 56. The transducers 72, 74 are then located so that the indexing flange 68 in each of the transducer apertures 64, 66 is located, in a complimentary fashion, within a groove 80 which corresponds with the desired location of the transducer working surface from the borehole wall so that an optimum distance or set off distance may be achieved. The lower and upper halves of the transducer head are then reassembled, and the transducer head and scanner sub may be lowered by wire line into the borehole. A comparison of FIGS. 4 and 5 reveals that the transducer scanning radius "r" is greatly variable.

The interfitting grooves 80 and flange 68 form an indexing system which permits fine control over the amount of adjustment of the transducer so that the standoff distance for a transducer can be optimized. For example, a transducer head assembly for use with conventional scanning subs might use a housing 52 which has a 7 inch fixed diameter. The indexing system used would permit the transducers 72, 74 to be adjusted in 0.25 inch increments. The exemplary transducer shown in FIG. 7 has a series of ten consecutive grooves 80 which are illustrated in FIG. 7 as grooves A through J. The interfitting of various of the grooves 80 with the flange 68 results in an adjustable transducer scanning radius "r" as follows:

| GROOVE | SCANNING RADIUS "r" (in inches) |
|---|---|
| A | 3.00 |
| B | 3.25 |
| C | 3.50 |
| D | 3.75 |
| E | 4.00 |
| F | 4.25 |
| G | 4.50 |
| H | 4.75 |
| I | 5.00 |
| J | 5.25 |

As a result of this indexing system, rotating diameters may be achieved which range from 6" to 10.50". With these exemplary sizes, only a single transducer head is needed to conduct scanning of boreholes having various sizes ranging from approximately 8.5" to approximately 13." The adjustable nature of the transducer with respect to the housing permits a number of transducer scanning radii to exist while only a single head is used. From these, a desired transducer scanning radius is selected by an operator at the time that the transducers 72, 74 are being affixed to the transducer head 50 in the manner described above.

In one presently preferred embodiment of the invention, one of the two transducers, say 72, is electrically disabled so that it does not operate to produce or receive a signal. Nonetheless, both of the transducers 72 and 74 are adjusted in a mirrored fashion so that the head 50 remains balanced as the weight of the transducers is moved inwardly or outwardly with respect to the head 50. Therefore, if operational transducer 72 is adjusted so that a transducer scanning radius of 4.75 inches is provided, the non-operational transducer 74 is also adjusted so that an equal non-operational transducer scanning radius (i.e., the distance from transducer 74's non-operational working surface 78 to the center of the head 50) is also presented.

In a second preferred embodiment for the invention, the both of the transducers 72, 74 are operable to produce and receive ultrasonic signals. The surface electronics 34 are, of course, modified in accordance with known practice to accommodate receipt and interpretation of two transducer signals. The use of two diametrically opposed transducers in accordance with a rotating head is known in the art. An example of such is found in U.S. Pat. No. 5,043,948, issued to Hallmark et al. and assigned to the assignee of the present application. This reference is hereby incorporated by reference. The inclusion of two operable transducers has the advantages of permitting the rotation rate for the transducer head 50 to be reduced by half while permitting the same amount of information to be gathered concerning the wellbore. In this form of the invention, the two operational transducers 72 and 74 are also disposed within the transducer head 50 in a mirrored relation so that the head 50 will remain balanced regardless of whether the transducers are adjusted inwardly or outwardly with respect to the head 50. A first transducer scanning radius is formed by disposal of the first operational transducer 72 within the head 50 so that the distance from the working surface 78 of the transducer 72 approximates a desired placement of the working surface 78 from the axis of the tool 30. The second operational transducer 74 is then disposed within the head 50 so that the distance from its working surface 78 also approximates the desired placement of the working surface 78 from the axis of the tool 30.

Once the transducers 72 and 74 have been adjusted, as described above, so that a desired transducer radius is achieved, the tool 30 and head 50 are disposed within the wellbore 10 to a desired depth. The transducer head 50 is then rotated so that the wellbore can be scanned circumferentially by the operational transducer or transducers of the pair of transducers 72, 74.

The invention contemplates that additional methods of adjusting the transducers with respect to the transducer head to alter the transducer radius may be used. For example, the transducers and transducer aperture might be threaded in a complimentary manner such that rotation of the transducer within the aperture would cause the transducer working surface to move radially outwardly or inwardly. Further, a servomotor might be disposed within the transducer head and associated with each of the transducers such that it could move each of the transducers radially inwardly or outwardly upon receipt of certain commands. These commands can be provided via the wireline.

Those skilled in the art will recognize that many modifications and variations besides those specifically mentioned may be made without departing substantially from the concept of the present invention. Accordingly, it should be understood that the forms of the invention described and illustrated herein are exemplary only and are not intended as limitations on the scope of the present invention.

What is claimed is:

1. A transducer head assembly for use in wireline logging, the assembly comprising:

a head housing having a transducer aperture, the housing being mounted within a logging string for rotation;

a transducer disposed within said aperture; and means for adjustment of the transducer between radially inward and outward positions with respect to the housing.

2. The assembly of claim 1 wherein the means for adjustment comprises an indexing system having two or more grooves associated with the transducer and at least one flange associated with the head and which is shaped to fit within either of the grooves.

3. The assembly of claim 2 further comprising means for preventing rotation of the transducer within the transducer aperture.

4. The assembly of claim 3 wherein the means for preventing rotation of the transducer within the transducer aperture comprises a locating pin which is shaped to fit within complimentary areas upon the transducer and the housing.

5. The assembly of claim 1 wherein the means for adjustment comprises a servomotor.

6. The assembly of claim 1 wherein the means for adjustment comprises a complimentary threading arrangement for the transducer and the transducer aperture.

7. An apparatus for conducting scanning-type logging of a borehole, the apparatus comprising:

a transducer head having at least one transducer mounted thereupon;

means for rotating the transducer head within a borehole; and means for adjusting the transducer for establishing a plurality of different scanning radii.

8. The apparatus of claim 7 wherein the transducer head has two transducers mounted thereupon which are operable to conduct scanning-type logging of a borehole.

9. A method of conducting wellbore logging comprising:

affixing a transducer to a rotatable transducer head such that the transducer may be adjusted radially inward and outward with respect to the transducer head;

disposing the transducer head and transducer within a wellbore; and rotating the transducer head within the wellbore to scan the wellbore circumferentially.

10. The method of claim 9 wherein the affixing step further comprises establishing a desired transducer scanning radial position.

11. A method of conducting wellbore logging comprising the steps of:

a. disposing a first transducer within a rotatable transducer head to establish a first transducer scanning radius;

b. establishing a second transducer scanning radius by disposing a second transducer within a rotatable transducer head, the second transducer scanning radius being substantially equal to the first transducer scanning radius;

c. rotating the transducer head within the wellbore to scan the wellbore circumferentially;

d. moving the first transducer to a third transducer scanning radius; and e. moving the second transducer to a fourth transducer scanning radius, the fourth transducer scanning radius being substantially equal to the third scanning radius.

12. The method of claim 11 wherein second transducer is non-operational.

13. The method of claim 11 wherein second transducer is operational.

14. The method of claim 10 wherein the radial position of the first transducer is indexed.

15. The method of claim 10 wherein the radial position of the first transducer is threadedly graduated.

16. A method of conducting wellbore logging comprising the steps of:

a. disposing a transducer within a rotatable transducer head to establish a first transducer scanning radius;

b. disposing a balancing weight within the rotatable transducer head at a radius substantially equal to the first transducer scanning radius;

c. rotating the transducer head within the wellbore to scan the wellbore circumferentially;

d. moving the first transducer to a second scanning radius that is different from the first scanning radius; and e. moving the balancing weight to a radius substantially equal to the second scanning radius.

17. The method of claim wherein the balancing weight is a second transducer.

18. The method of claim 17 wherein the second transducer is operational, further comprising scanning the wellbore using both the transducer and the second transducer.

19. The apparatus of claim 8 wherein the rotating means comprises a motor operatively engaging the transducer head and wherein the adjusting means comprises a plurality of annular grooves provided on said transducers and corresponding indexing flanges formed on said transducer head.

20. The apparatus of claim 8 wherein the rotating means comprises a motor operatively engaging the transducer head and wherein the adjusting means comprises a servomotor associated with the transducers, the servomotor moving the transducers radially inwardly or outwardly upon receipt of commands.

21. The apparatus of claim 7 wherein the rotating means comprises a motor operatively engaging the transducer head; and wherein the adjusting means comprises a plurality of annular grooves provided on said transducer that engage an indexing flange formed on said transducer head.

22. The apparatus of claim 7 wherein the rotating means comprises a motor operatively engaging the transducer head; and wherein the adjusting means comprises a servomotor associated with the transducer, the servomotor moving the transducer radially inwardly or outwardly upon receipt of commands.

* * * * *